US006186357B1

(12) United States Patent
Kyle

(10) Patent No.: US 6,186,357 B1
(45) **Date of Patent: *Feb. 13, 2001**

(54) HATCH ASSEMBLY WITH REMOVAL HATCH COVER

(75) Inventor: James H. Kyle, Keene, NH (US)

(73) Assignee: Pompanette, Inc., Charlestown, NH (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/245,080

(22) Filed: Feb. 5, 1999

Related U.S. Application Data

(60) Provisional application No. 60/073,803, filed on Feb. 5, 1998.

(51) Int. Cl.[7] ..... B65D 25/54; B65D 51/04; B65D 53/00

(52) U.S. Cl. ..... 220/841; 16/355; 220/664; 220/849

(58) Field of Search ..... 220/841, 810, 220/845, 849, 378, 4.02, 484, 836, 663, 664, 662; 16/224, 231, 254, 260, 269, 355

(56) References Cited

U.S. PATENT DOCUMENTS 2,117,228 * 5/1938 Stuchbery ..... 220/841
2,195,161 * 3/1940 Baker ..... 220/841
2,233,326 * 2/1941 Rooney ..... 220/841
2,302,661 * 11/1942 Benson ..... 220/841 X
2,559,009 * 7/1951 Coyle et al. ..... 220/841
2,785,823 * 3/1957 Zarges ..... 220/841 X
3,671,998 * 6/1972 Ruiz ..... 16/229
4,099,648 * 7/1978 Kirkton ..... 220/841
4,852,213 * 8/1989 Shewchuk ..... 16/260 X
4,854,475 * 8/1989 Riihimaki et al. ..... 220/841 X
5,274,882 * 1/1994 Persson ..... 16/229 X
5,329,667 * 7/1994 Erskine ..... 16/355 X
5,566,992 * 10/1996 anderson et al. ..... 292/241

* cited by examiner

*Primary Examiner*—Allan N. Shoap
*Assistant Examiner*—Niki M. Eloshway
(74) *Attorney, Agent, or Firm*—Dougherty & Troxell

(57) ABSTRACT

A hatch assembly with a removable cover comprises a generally rectangular frame member, a pair of two piece hinge assemblies and a mating cover which is rotatably attached to the frame member by the hinge assemblies. Each of the two piece hinge assemblies include a first hinge element which has a generally J-shaped pivot member and a second hinge element having a longitudinally extending generally cylindrical recess and a longitudinally extending slot along one side thereof. The generally cylindrical recess and slot are adapted to receive the J-shaped pivot member therethrough and into the recess when the cover is in a first position as for example 120° from its closed position. When the cover is rotated toward closure, the J-shaped pivot member is retained within the recess so that the cover can be rotated between about 110° and 0°. Then when rotated to 120° the cover can be readily removed from the frame.

4 Claims, 8 Drawing Sheets

HATCH ASSEMBLY WITH REMOVAL HATCH COVER

This application claims the benefit of an earlier filed U.S. Provisional Application Serial No. 60/073,803 which was filed on Feb. 5, 1998.

FIELD OF THE INVENTION

This invention relates to an improved hatch assembly with a removable hatch cover and more particularly to a hatch cover and hinge which permits the cover to be removed after rotation beyond a preselected angle.

BACKGROUND FOR THE INVENTION

Cast aluminum and plastic hatch assemblies are well known. For example, such hatches are commercially available from Pompanette, Inc. of Charlestown, N.H., the assignee of the present invention. They are described in the U.S. Patent of A. Anderson entitled "Mechanism for Latching and Unlatching a Hatch Assembly", U.S. Pat. No. 5,566,992 which is assigned to the same assignee as the present invention. That application is included herein in its entirety by reference. Such assemblies typically include a cast aluminum alloy frame, an elastomeric gasket and a clear plastic cover. The hatch covers are typically made of a clear or tinted LEXAN sheet, a product of General Electric. These cast aluminum frames and clear plastic covers are however, susceptible to scratches during assembly, installation and removal of the assembly and when the cover is being removed or replaced by the owner of a vessel.

The prior art discloses a number of hinge assemblies which facilitate disassembly, as for example, the hinge disclosed in the U.S. Pat. No. 3,671,998 of Ruiz. The Ruiz patent discloses a hinge comprising first and second parts which move around an axis. The first part comprises two retractable pivots which can be inserted into a corresponding housing. The pivots are separated by a compression spring and are joined to a pin which slides along or within an oblong hole within a cylindrical body of the first part. This oblong hole has a slot to block the pin on each pivot in a locking position for taking the hinge to pieces.

Another hinge mechanism is disclosed by Persson, U.S. Pat. No. 5,274,882 entitled, "Hinge Mechanism". In the Persson device, a first hinge portion and a second hinge portion are urged toward predetermined angular relationships relative to one another, A force is applied by an axle which pivotally connects the first and second hinge portions to urge a V-shaped tip into a V-shaped groove in the second hinge portion. The first and second hinge portions are kept in a predetermined angular relationship until a torsional force overcomes the force which is keeping the V-shaped tip in the V-shaped groove.

The aforementioned hinge mechanisms may be useful for a number of applications, but apparently have not been accepted for marine hatch assemblies. It is believed that the aforementioned mechanisms have not been utilized for marine hatch assemblies be cause they have a number of drawbacks and do not provide a number of advantages which are inherent in the novel hatch assemblies disclosed herein. For example, the prior art devices are not completely suitable for a low profile installation of relatively simple construction.

It is also believed that there is a significant commercial demand for an improved marine hatch assembly in accordance with the present invention. Such assemblies have a relatively low profile, are of relatively simple construction and have a pleasing appearance. The hatch assemblies disclosed herein can be manufactured and sold at a competitive price, are durable and relatively free from maintenance. In addition, the hatch assemblies in accordance with the present invention facilitate the removal and replacement of a transparent or translucent hatch cover. The assemblies also minimize the likelihood of scratching or scaring the frame or lens during installation or removal from the vessel.

BRIEF SUMMARY OF THE INVENTION

In essence, a marine hatch assembly in accordance with the present invention includes a frame member defining a central opening. The frame member which may be of any suitable shape as for example a generally rectangular frame member with a matching or mating cover ie a cover which engages the frame in a superimposed position when closed. The assembly also includes suitable gasket means for sealing the cover and frame when in a fully closed position. A key element in the present invention resides in a two piece hinge construction or hinge. In that construction, a first hinge member is fastened to either the frame member or hatch cover, preferably to the frame member, and includes a longitudinally extending generally J-shaped portion which extends above and outwardly from the frame member. A second hinge element is fixed to the other of the frame member or cover, preferably to the cover and includes a longitudinally extending generally cylindrical portion with a longitudinally extending open slot along one side thereof. The cylindrical portion preferably has a length which is about equal to and parallel to the generally J-shaped portion of the other element. The cylindrical portion is also sized so that the J-shaped element fits within the cylindrical portion. The J-shaped portion is also constructed and arranged so that the slot in the cylindrical portion can slip over an outwardly extending part of the J-shaped portion when the cover is rotated to a preselected position for removal or installation of the hatch cover. Then as the cover is rotated about the J-shaped portion the J-shaped portion is fully encased within the cylindrical portion.

The invention will now be described in connection with the accompanied drawings wherein like reference numerals have been used to indicate like parts.

DETAILED DESCRIPTION OF THE PREFERRED EMBODIMENTS OF THE INVENTION

Figure 5:
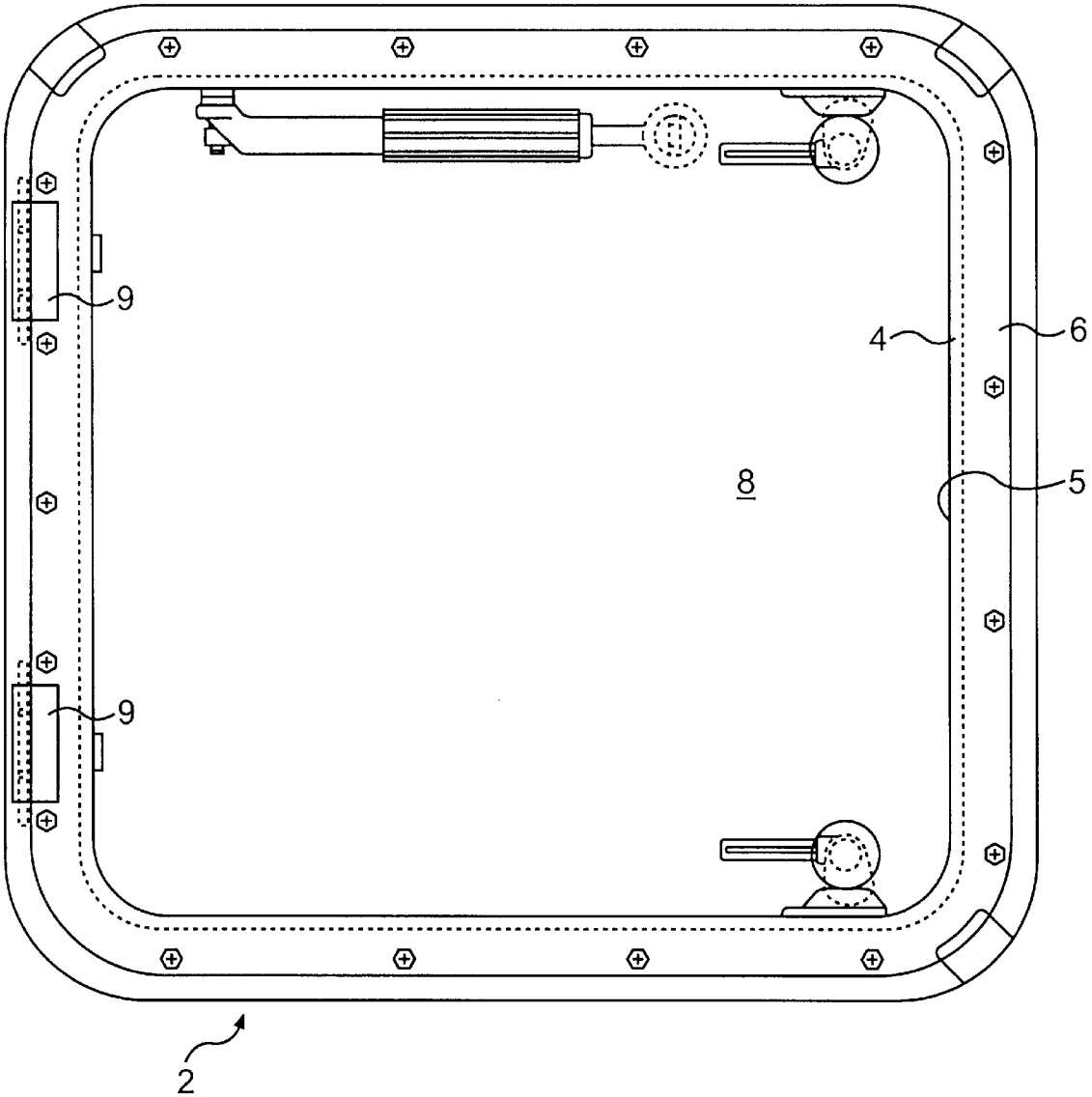
FIG. 5 is a plan view of a hatch assembly in accordance with the invention with the hatch in a closed position.

A hatch assembly 2 for a marine vessel or the like will now be described with reference to the accompanying drawings. The hatch assembly 2 has a shape such as the generally rectangular shape shown in FIG. 4 and is adapted to fit into an opening in a vessel in a customary manner. The shape may take other forms, such as oval, round or generally square. As shown more clearly in FIGS. 1A–D and 2A–F, the hatch assembly includes a frame member 4 which defines a generally rectangular opening 5 as shown in FIG. 5. The assembly 2 also includes a generally rectangular transparent or translucent hatch cover 8 with a shape that corresponds to the shape of the opening 5. The cover 8 is disposed outwardly from the first frame member 4 and is about the same size as the opening 5 or slightly larger and is adapted for closing the opening ie closing the hatch when the cover 8 is in a super-imposed position with respect to the frame member 4.

In one embodiment of the invention, the cover 8 is hingedly connected to the frame 4 by one or more, preferably two two piece hinges 9. For example, the two piece hinge 9 includes a first hinge element 10 such as a flat plate portion 12. The flat plate portion 12 includes one or more countersunk holes 13 for attaching the element 10 to the frame member 4. The first hinge element 10 also includes one or more generally J-shaped pivot members or connecting elements 14 which are connected or fixed to the flat plate portion 12 by means of extension members or portions 16.

The generally J-shaped pivot members or connecting elements 14 include a longitudinally extending lip 14' which is generally parallel to the plate 12 and to the axis of rotation ie the axis about which the cover 8 rotates.

The two piece hinge 9 also includes a second hinge element 20 which has a longitudinally extending cylindrical portion or recess 22 which defines a longitudinally extending opening or slot 24. In some cases a plurality of slots 24 may be provided. The hinge element 20 also includes an L-shaped portion 26 inwardly of the slot 24 i.e. toward the center of the cover 8. The portion 26 is adapted to receive the lens element or cover 8 against it in an abutting relationship. The cover 8 which is preferably transparent or translucent but may also be opaque, is attached to the L-shaped portion 26 in a conventional manner which will be understood by persons of ordinary skill in the art. A gasket 30 is also fixed to the cover 8 in a conventional manner for sealing engagement with a frame 4 when the hatch assembly is in a closed position.

Figure 1B:
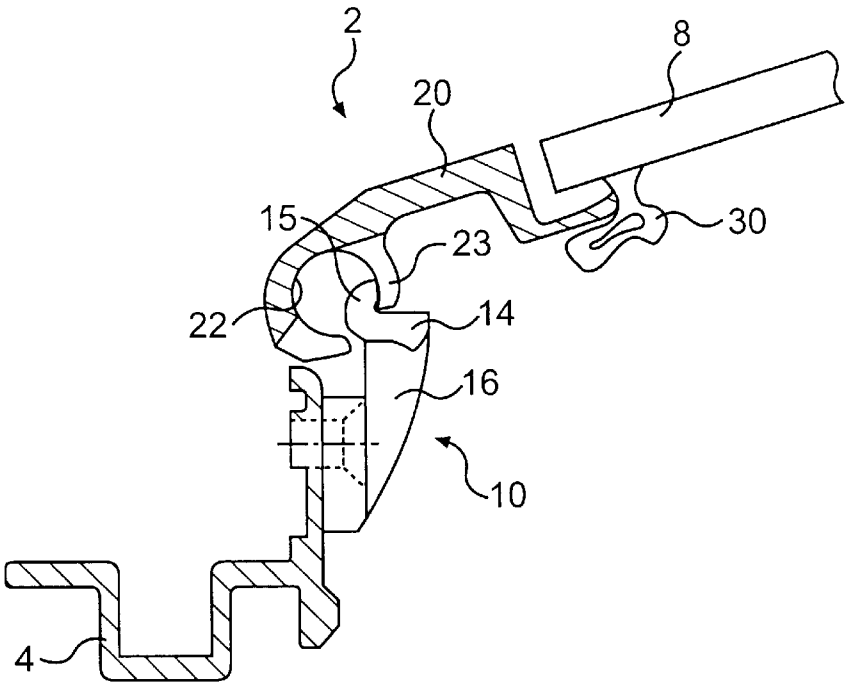
FIG. 1B is a cross sectional view of the hinge assembly shown in FIG. 1A but with the second element of the hinge positioned for installation or removal of the hatch cover.
Figure 1A:
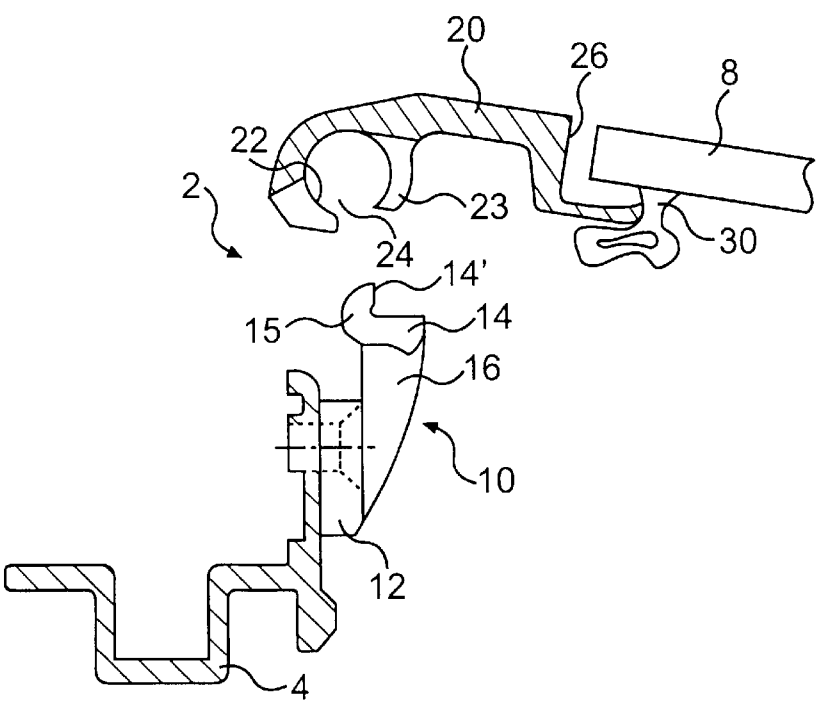
FIG. 1A is a cross sectional view which illustrates a portion of a hinge assembly with a first element of the hinge assembly separated from a second element of the hinge assembly.
Figure 1D:
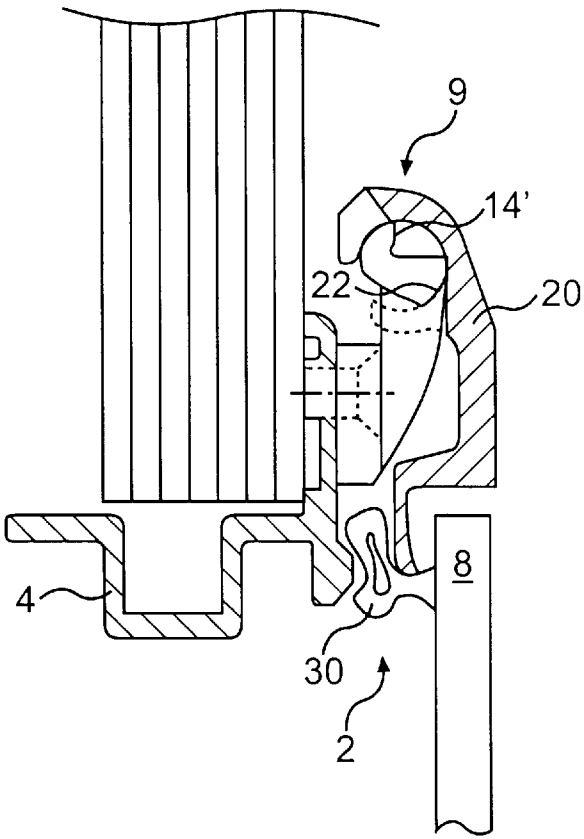
FIG. 1D is a cross sectional view which illustrates the hatch assembly shown in figures 1A–C but with the assembly shown in a closed position.
Figure 1C:
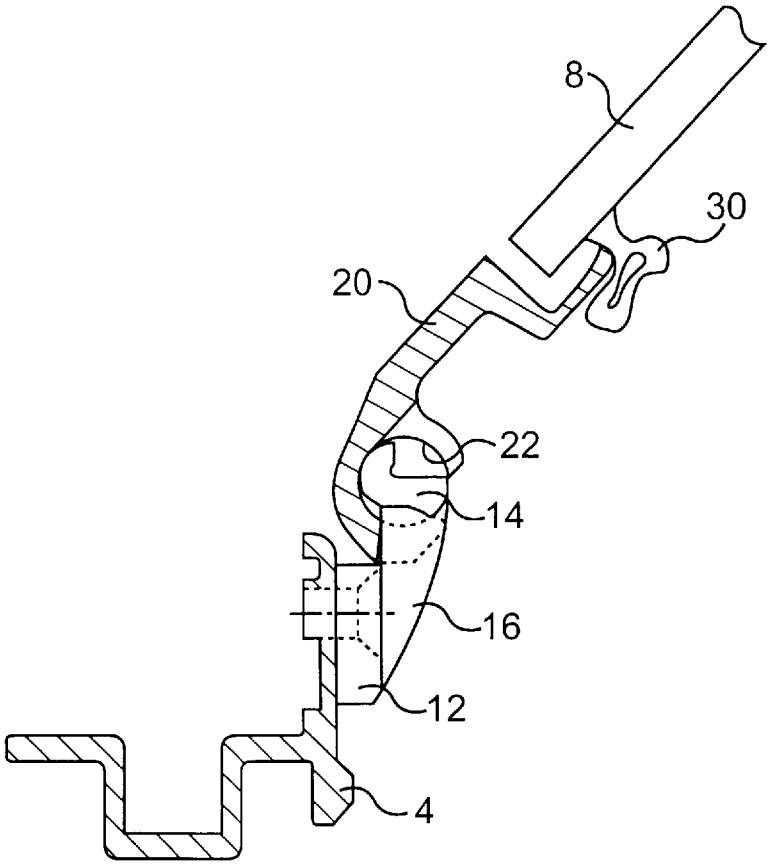
FIG. 1C is a cross sectional view of the hinge assembly shown in FIGS. 1A and 1B, but with the hatch cover and hinge rotated so that a J-shaped portion of a hinge is fully engulfed by the cylindrical portion ie a position through which the hatch cover can freely rotate without a likelihood of being removed from the assembly.
Figure 2A:
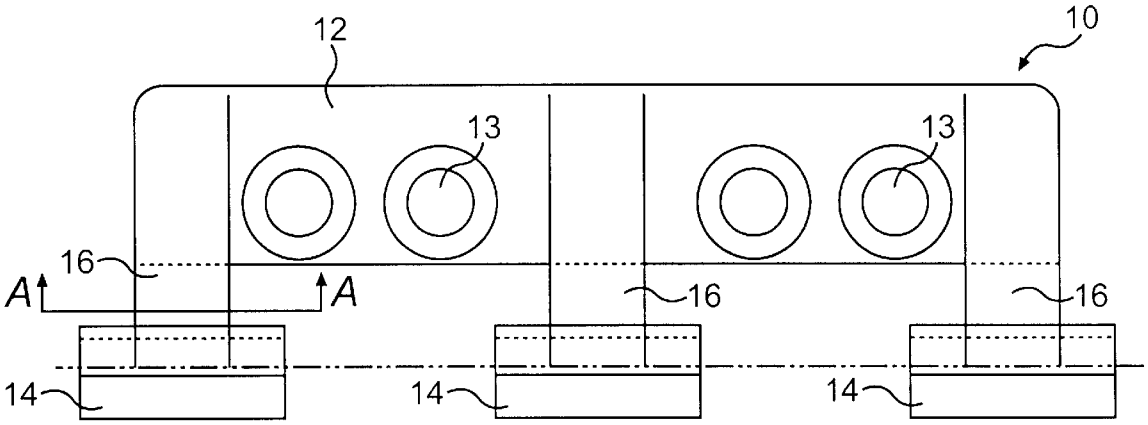
FIG. 2A is a top or plan view of a first element of the hinge assembly.
Figure 2B:
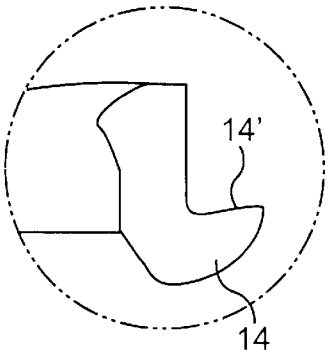
FIG. 2B is an end view illustrating the generally J-shaped cross section of the first element of the hinge assembly shown in FIG. 2A.
Figure 2D:
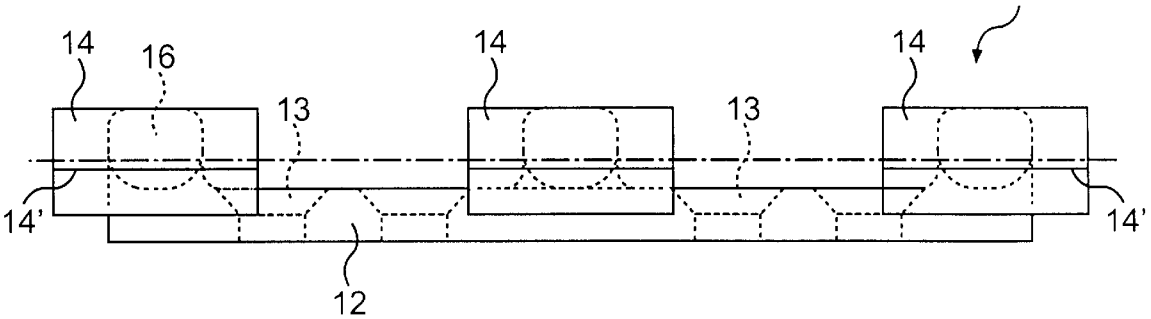
FIG. 2D is a side elevational view of the first element of the hinge shown in FIG. 2A.
Figure 2C:
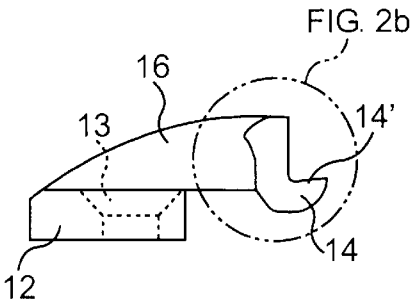
FIG. 2C is an end view of the first element of the hinge assembly shown in FIG. 2B.
Figure 2E:
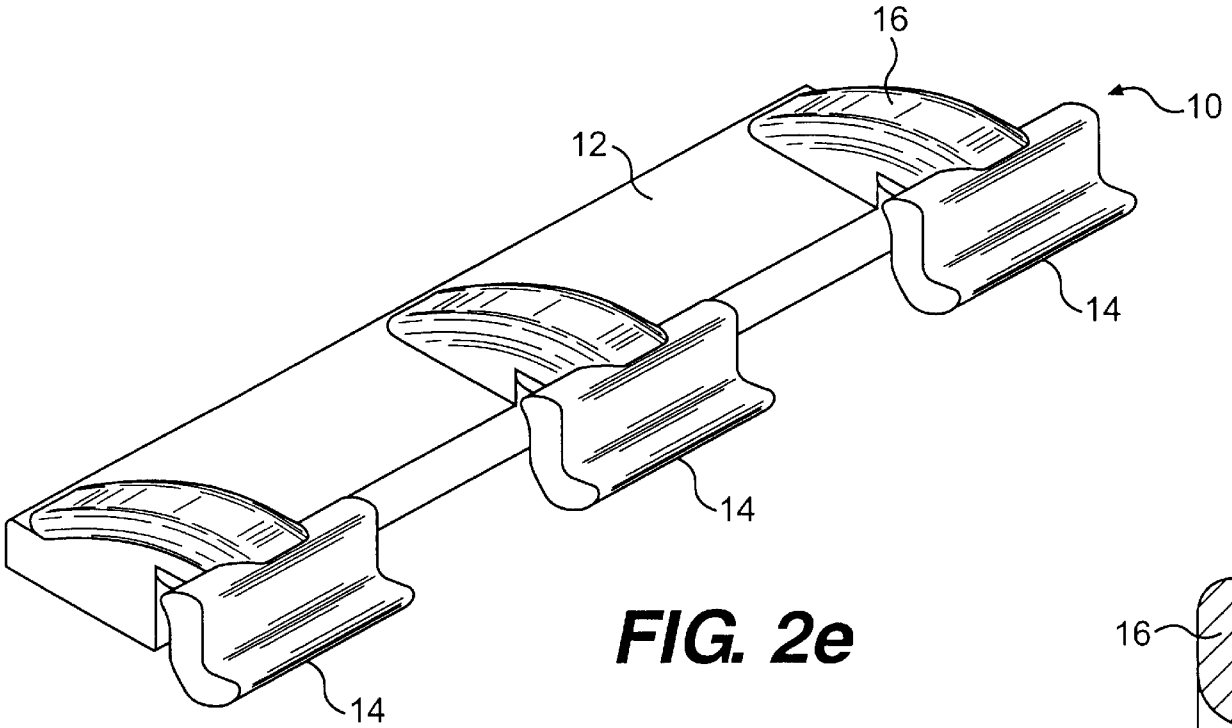
FIG. 2E is a perspective view of the first element of the hinge assembly shown in FIGS. 2A–2D.
Figure 2F:
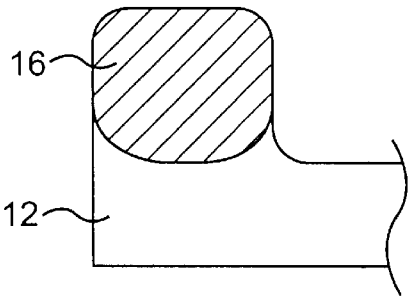
FIG. 2F is a cross sectional view taken along the line A—A in FIG. 2A.
Figure 3:
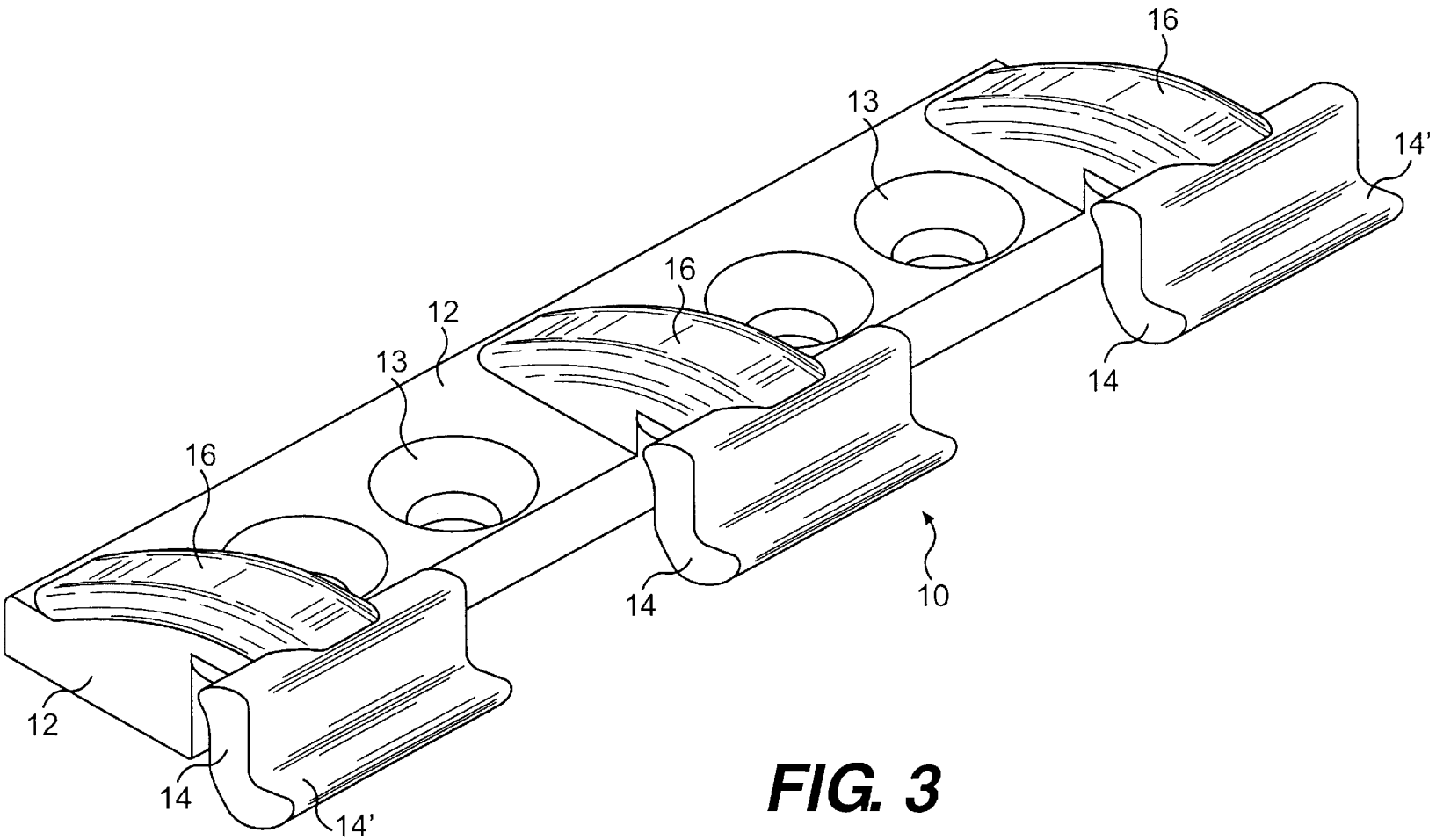
FIG. 3 is an enlarged perspective view which shows the first element of the hinge assembly shown in FIG. 2E.
Figure 4B:
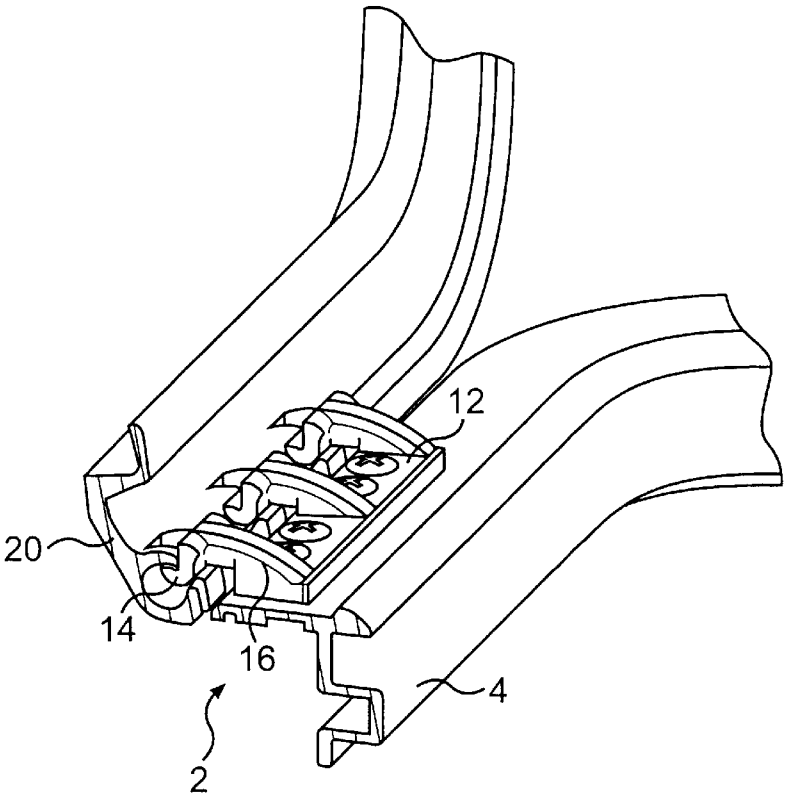
FIG. 4A–4D are a perspective views which illustrate the preferred embodiment of the invention.
Figure 4A:
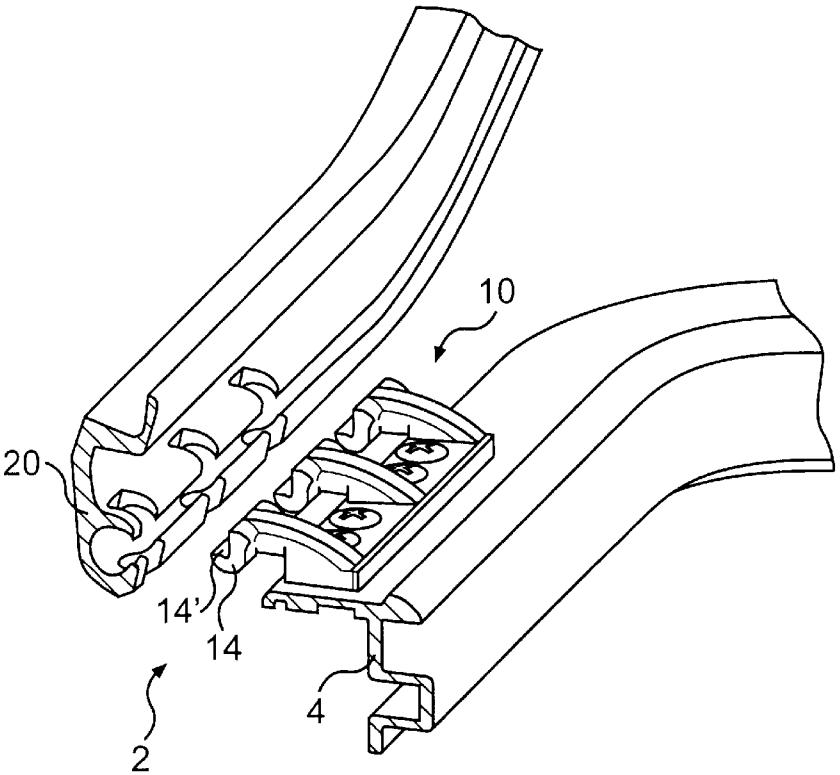
Figure 4D:
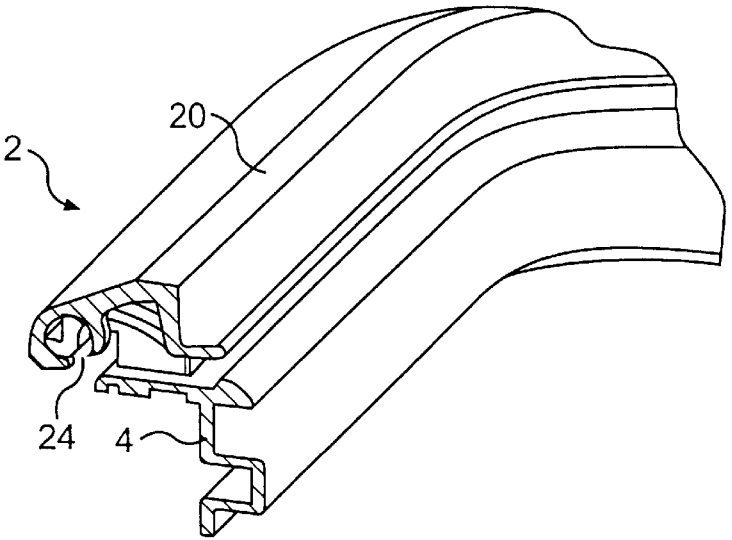
Figure 4C:
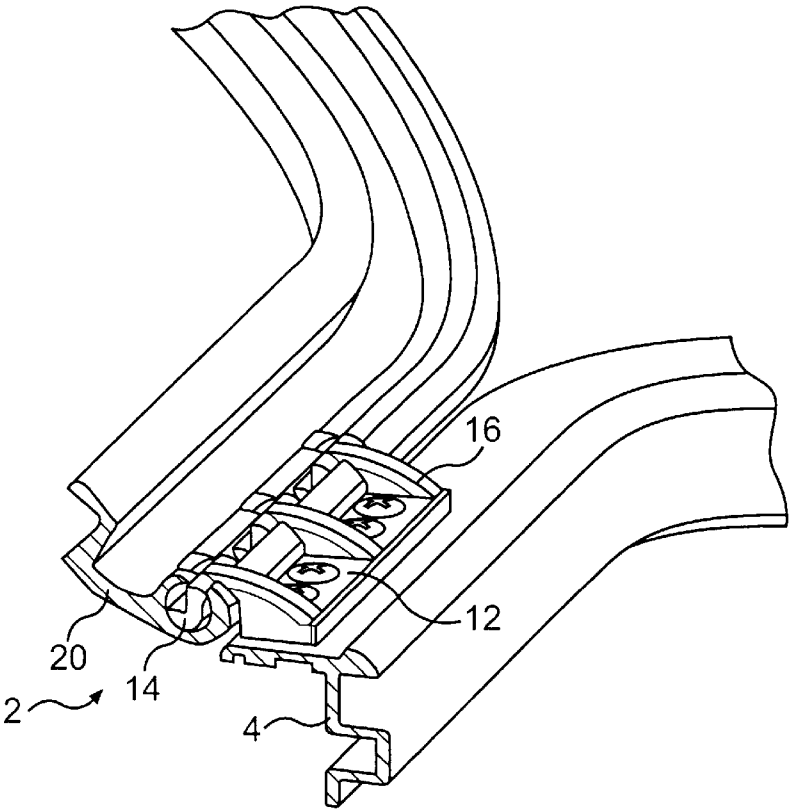

As illustrated in FIGS. 1A–1D, the hatch cover 8 may be installed by positioning the cover 8 so that the opening 24 is above and position over the base portion 15 of the J-shaped connecting element or pivot member 14 as illustrated in FIG. 1A. The opening 24 is then lowered over the base portion 15 of the pivot member onto one arm or ear 23 (1st C-shaped portion) until the ear 23 engages the lip 14'. The cover 8 of the cylindrical portion 22 is then rotated upwardly until a second arm or ear 25 ($2^{nd}$ C-shaped portion) of the cylindrical portion 22 almost encompasses the J-shape element 14 and is snapped into the position as illustrated in FIG. 1C. The cover 8 can then be rotated into a fully closed position as illustrated in FIG. 1D. The hatch assembly can then be rotated into a open or closed position about the hinge 9.

To remove the hatch cover 8 from the frame 4 it is only necessary to rotate the hatch to about 120°. In a preferred embodiment of the invention the hatch cover can be rotated from 0 to 110° and is prevented from being removed from the hatch frame by the hinge assembly.

As illustrated in FIG. 5 the hatch assembly may also include an adjustor mechanism and a pair of dogs which maintain the hatch in an open position or clamp it into a sealingly closed position in a conventional manner.

While the invention has been described in connection with its preferred embodiment, it should be recognized that changes and modifications may be made therein without departing from the scope of the appended claims.

What is claimed is:

1. A hatch assembly with a removable cover which is rotatable between an open and a closed position, said hatch assembly comprising a frame member defining an opening therein, a two-piece hinge assembly and a removable cover rotatably attached to said frame member by said hinge assembly for rotation about said hinge assembly between an open position and a closed position wherein said cover is superimposed on said frame member, said two-piece hinge assembly including a first hinge element having a generally flat plate portion for attaching said first hinge element to a hatch assembly, a plurality of longitudinally extending generally J-shaped pivot members and a plurality of upwardly extending support members connecting said J-shaped pivot members to said plate portion, said generally J-shaped pivot members including a rounded base portion and a rounded opposite or top portion with the same radius of curvature as said base portion, and a second hinge element including a longitudinally extending generally cylindrical recess defining a right circular cylinder with a longitudinal slot along one side thereof, said generally cylindrical recess having a curvature of surface which is slightly larger than the radius of curvature of said base portion and said opposite or top portion to allow said pivot member to rotate therein with a relatively snug fit and a plurality of transverse slots across said longitudinal slot, and said generally cylindrical recess and said longitudinal slot adapted to receive said J-shaped pivot members through said longitudinal slot and into said recess with said J-shaped pivot members encompassed by said recess when said cover is rotated about said J-shaped pivot members and said transverse slots sized to accommodate said support members as said cover is rotated though an angle of about 120° whereby said cover can be rotated between an open position and a closed position with said J-shaped pivot members retained in said longitudinally extending recess and readily removed from said frame when rotated to said open position.

2. A hatch assembly with a removable cover which is rotatable between an open and a closed position according to claim 1, which includes sealing means disposed between said frame member and said cover for sealingly engaging said frame and said cover when said cover is in a closed position.

3. A hatch assembly with a removable cover which is rotatable between an open and closed position in accordance with claim 1, wherein said rotatable cover can be opened through an angle of about 110° with said J-shaped pivot members maintained within said generally cylindrical recess and wherein said J-shaped pivot members can be readily removed from said generally cylindrical recess through said slot by rotating said rotatable cover to about 120°.

4. A hatch assembly with a removable cover which is rotatable between an open and a closed position in accordance with claim 3, includes a lens element and in which said second hinge element includes a L-shaped portion inwardly of said cylindrical recess for receiving said lens elements within said L-shaped portion.

* * * * *